United States Patent [19]

Joyce

[11] 3,990,601

[45] Nov. 9, 1976

[54] KNOCK-DOWN DISPLAY STAND

[76] Inventor: James E. Joyce, 878 Darien Circle, Rochester, Mich. 48063

[22] Filed: Nov. 14, 1975

[21] Appl. No.: 631,990

[52] U.S. Cl. ..... 220/21; 206/44 R; 211/72; 248/174

[51] Int. Cl.[2] ..... B65D 1/24; B65D 1/36; B65D 57/00; B65D 85/62

[58] Field of Search ..... 206/44 R, 45.19, 45.14, 206/45.34; 248/174; 229/5.5, 15; 211/72, 133; 220/4 B, 4 E, 21, 22, 80; 312/111, 257

[56] References Cited

UNITED STATES PATENTS

| | | | |
|---|---|---|---|
| 654,255 | 7/1900 | Hunter | 229/5.5 |
| 1,644,359 | 10/1927 | Stellmach | 248/174 |
| 1,752,369 | 4/1930 | Chapman | 211/72 |
| 2,514,364 | 7/1950 | Bates | 220/21 |
| 3,079,028 | 2/1963 | Rosner | 220/22 |
| 3,317,109 | 5/1967 | Palmer | 229/5.5 |

*Primary Examiner*—William T. Dixson, Jr.
*Attorney, Agent, or Firm*—Thomas N. Young

[57] ABSTRACT

A knock-down storage and display stand which is easily assembled without the use of tools or fastening devices. The stand is constructed of a light-weight material such as plastic or corrugated paperboard and comprises front and rear uprights having their bottom edges wedge-fitted within a peripheral channel in a rectangular base member. The adjacent vertical edges of the front and rear uprights are joined together by an extruded connector, and a top unit of slightly larger lateral dimensions than the rear uprights is fitted over the uprights.

12 Claims, 10 Drawing Figures

Fig-6
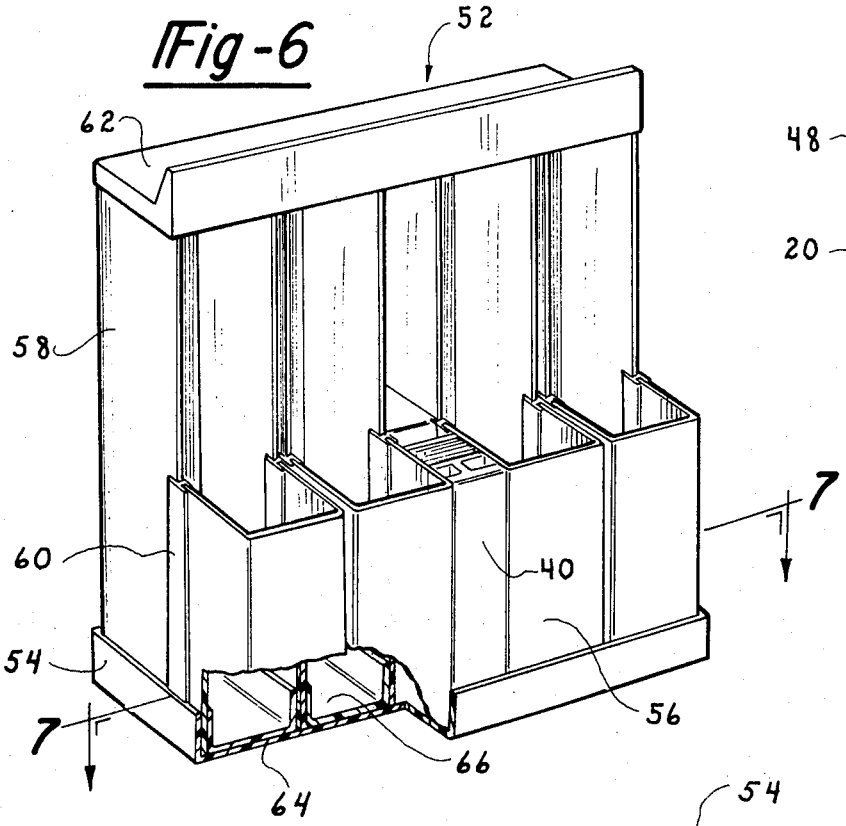
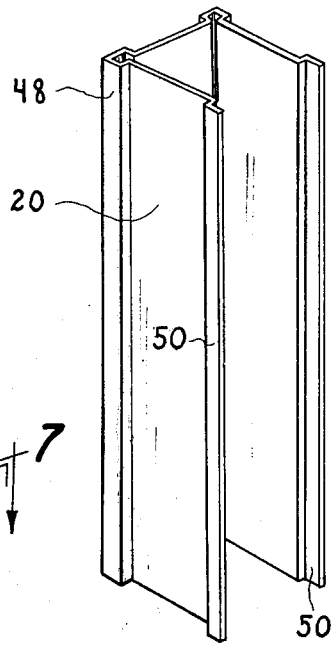
Fig-10
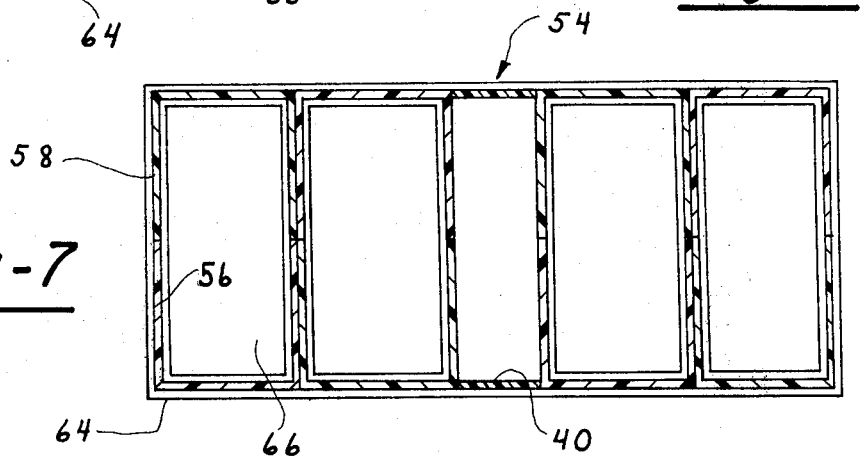
Fig-7
Fig-8
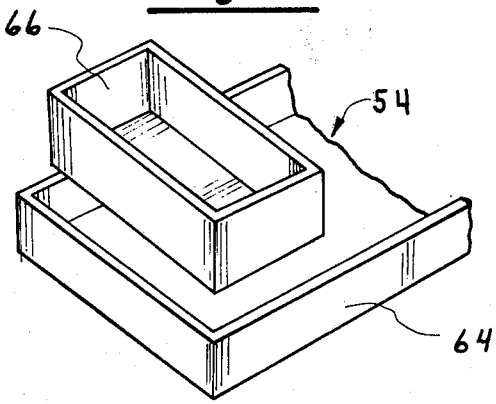
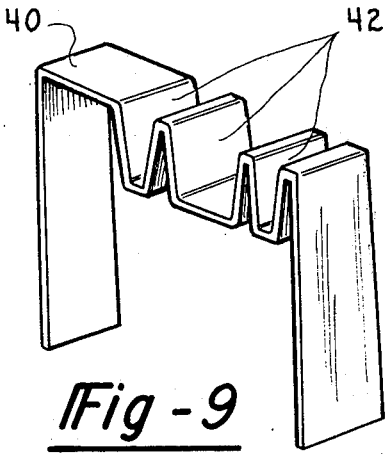
Fig-9

KNOCK-DOWN DISPLAY STAND

INTRODUCTION

The present invention relates to an attractive, free-standing storage and display stand of the type commonly used by retail stores to display and store goods for sale.

BACKGROUND OF THE INVENTION

Free-standing storage and display stands are widely used by retail stores as a convenient means of arranging goods within the store for presentation to consumers. Such stands typically comprise a framework and exterior members and require tools for assembly and disassembly. Such devices are not conveniently moved around within a store nor are they convenient to transport to other stores because of the time and effort involved in take-down and reassembly.

Therefore, it is among the objects of the present invention to provide a light-weight free-standing storage and display stand which is easily assembled without the use of tools or fasteners and yet provides a strong and rigid structure.

SUMMARY OF THE INVENTION

The present invention consists of a free-standing display stand comprising an integral base unit having a peripheral channel defined thereon. An upright unit having front and rear portions of dissimilar length is wedge-fitted into the channel of the base so as to define a semi-enclosed space. The mating or abutting edges of the upright unit may be joined together by an extruded connector element which adds rigidity to the constructed stand or by clips. The stand may also be equipped with a top which fits on the rear portion of the upright unit and provides a space for advertising. The components of the stand are preferably constructed of a light-weight molded plastic or corrugated paper material which gives the structure sufficient strength and rigidity and is very low in cost.

As will be described later in detail, the design of the present invention is readily adaptable to a multi-unit storage and display stand. An elongated base or pallet may be used which provides, in addition to the peripheral channel, intermediate channels spaced according to the width of the uprights. Sets of front and rear uprights are then simply wedge-fitted into the channels of the pallet in a side-by-side abutting relationship creating a row of bin storage areas. Another specific embodiment of the present invention comprises a two-part non-integral base unit. More specifically, the base unit consists of inner and outer rectangular boxes or other shapes with the outer box having slightly larger lateral dimensions than the inner box. The front and rear uprights are properly positioned in the outer box and the inner box is forced down inside the uprights to provide a press-fit which holds the uprights in place. The clearance between the boxes thus defines the peripheral channel described above with reference to the integral base unit. As before, the exterior box may be of sufficient size to accommodate two or more of the inner boxes in a side-by-side relationship. A series of front and rear uprights may be set in the exterior box and the individual inner boxes press-fitted between each pair of uprights.

Various other features and advantages of the invention will become apparent from a reading of the following specification which describes the preferred embodiments of the invention in detail.

BRIEF DESCRIPTION OF THE DRAWINGS

FIG. 6 is a perspective view of a modified quadruple bin stand with intermediate spacer;

FIG. 7 is a sectional view showing a base detail;

FIG. 8 is an exploded view of another base detail;

FIG. 9 is a perspective view of a spacer unit; and

FIG. 10 is a perspective view of an alternate upright form.

DETAILED DESCRIPTION OF THE ILLUSTRATIVE EMBODIMENTS

Figure 1:
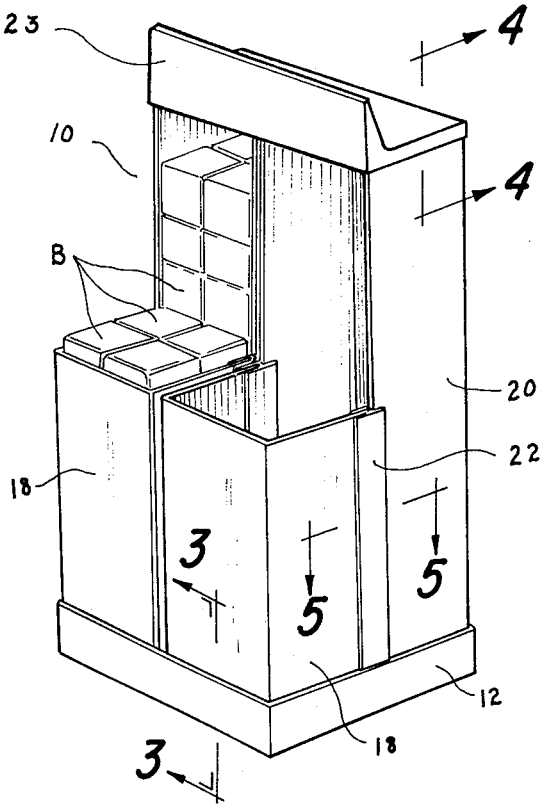
FIG. 1 is a perspective view of an assembled double bin storage and display stand with boxed products stacked therein.
Figure 2:
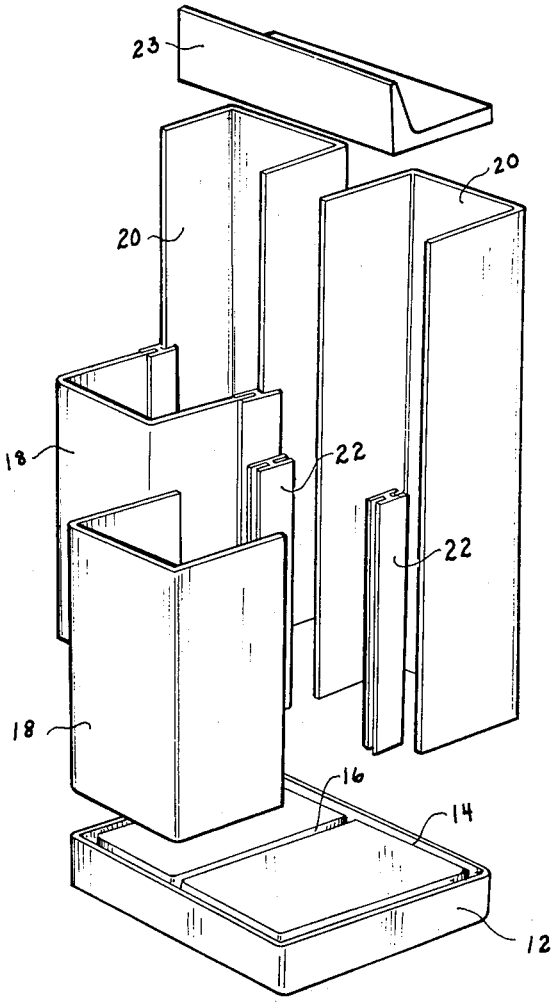
FIG. 2 is an exploded perspective view of the stand.
Figure 3:
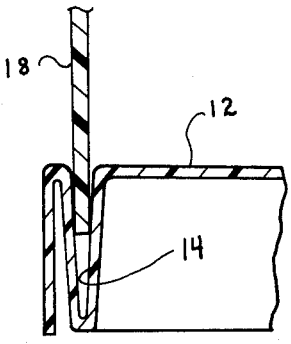
FIG. 3 is a sectional view showing a base detail.
Figure 5:
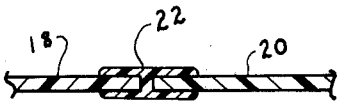
FIG. 5 is another sectional view showing a connector detail.
Figure 4:
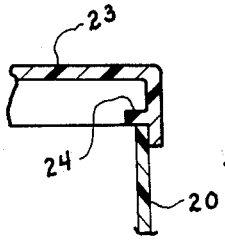
FIG. 4 is another sectional view showing a top detail.

Referring first to FIGS. 1 through 3, a semi-enclosed double bin free-standing storage and display stand 10 embodying the present invention is shown. The stand 10 is approximately 4½ feet in height, 2 feet in width, and approximately 2 feet in depth. Stand 10 provides a semi-enclosed space which is capable of receiving prepackaged goods for sale, such goods being easily and attractively stacked within the confines of the stand so as to display both top and end surfaces of the boxes B as shown. In this arrangement the boxes B are easily reached by customers who wish to examine the boxes or who have made a decision to purchase.

The stand 10 comprises five basic structural components, some of which appear more than once in the stand 10 and all of which are preferably molded from a suitable rigid thermosetting plastic material such as polystyrene. However, alternative materials such as corrugated paperboard, commonly known as "cardboard" or other light-weight structural materials may be employed. The five basic structural components are: a pallet or base 12, a front upright unit 18, a rear upright unit 20, an extruded connector 22, and a top 23. All of the components are dimensioned so as to interfit with one another to fabricate the stand 10 without the need for conventional fastener devices such as screws, bolts, washers, and so forth and without the need for any interior framework or the like.

Looking to FIGS. 2 through 5, the details of the components may be more readily appreciated. In FIG. 2 the base 12 is shown to comprise a shallow thin-walled box-like structure having a deep drawn peripheral channel 14 and a center channel 16 which runs from front to back over the entire depth of the base 12 as shown. In the molding process the drawing of the groove or channel 14 is such as to produce a shallow taper; i.e., the groove becomes narrower toward the bottom, such that the bottom edges of the U-shaped single wall uprights 18 and 20 may be press-fit into the peripheral groove to assemble the uprights to the base; this is shown in FIG. 3. The central channel 16 is substantially twice the width of the peripheral channel 14 in the double bin structure 10 shown in FIG. 1 since it must accommodate the inside bottom edges of two side-by-side upright sets.

The front upright 18 is a single wall thickness molded non-cellular plastic structure having a generally U-shaped configuration being approximately 4 feet high by 1 foot wide by 1 foot in depth. Rear upright 20 is identical but twice as tall. All of these dimensions are given strictly by way of illustration and it is possible that a given display unit may be best implemented using wider and taller front and rear uprights so as to provide greater storage capacity. The wall thickness of the uprights 18 and 20 is such as to be capable of a press-fit into the channel 14 of the base 12 with the lower side of one panel extending into the central channel 16 so as to provide the double bin arrangement in the manner shown in FIG. 1. The tightness of the press-fit is exaggerated in FIG. 3.

The rear upright 20 is substantially identical to the front upright but is twice as tall, again, this dimensional relationship given purely by way of illustration. The wall thickness of the rear upright as well as the width of the rear upright 20 is identical to that of the front upright 18 so that the bottom edge of the rear upright fits into the channel 14 and the front facing edges of the rear upright 20 abuttingly mate the rear facing edges of the front upright 18 to define the semi-enclosed space or volume within each bin of the stand 10. As suggested in FIGS. 1, 2, and 5, an extruded plastic or aluminum connector unit 22 may be placed between the upstanding edges of the uprights 18 and 20 so as to act as a rigidifying interface between the two units. This connector unit prevents any relative lateral movement between the abutting edges of the rear and front upright units and, because the interior slots or channels of the connector 22 are preferably molded in a tapered configuration, a tight friction fit is achieved, thus increasing the fore and aft stability of the stand 10.

The top 23 is slightly wider in dimension than the lateral stand of the rear upright 20 and is provided with an internal flange 24 so as to fit on and over the upright 20 in the manner of a cap. The front panel of the top 23 provides a convenient place for advertising material such as stick-on paper sheets, decals, etc.

It can be seen that the stand 10 is easily assembled simply by placing the base 12 in the desired position and locating the front and rear uprights 18 and 20 into the channels 14 and 16 of the base. The uprights 18 and 20 may first be assembled using the connector 22 and then dropped into the channel 14 of the base 12 after which the top 23 is set in place. It can be seen that the stand 10 is easily assembled as well as disassembled without the use of any tools or conventional connector devices.

Looking now to FIG. 10, an alternative form is shown for the rear upright 20'. In FIG. 10 the upright is either molded or bent from a flat blank into a U-shaped configuration but having outwardly stepped corners 48 and edges 50. It will be recognized by those skilled in the materials art that the outward steps provide additional rigidification and thus allow construction of the upright 20' from a lighter, less rigid material. It is apparent that the fabrication of the upright unit 20' in the manner shown in FIG. 4 requires a complementary configuration of the base 12 as well as the front upright unit. These configurations will not be illustrated herein since they will be apparent from the disclosure of FIG. 10.

Looking now to FIGS. 6 through 9, a further alternative structure will be described. FIG. 6 shows a four-bin stand 52 of which the basic components are again made of molded plastic or cardboard material. The stand 52 comprises a base 54, front and rear uprights 56 and 58, respectively, connectors 60, and a top 62. The base 54, like base 12 of stand 10, affords a peripheral groove to receive the lower edges of uprights 56 and 58. However, the channels or grooves of base 54 are defined by clearances between the sides of outer and inner box units 64 and 66, respectively. As shown in FIG. 7, the inner boxes sandwich the lower side and rear panels of the uprights 54 and 56 between themselves and the outer box 64. In addition, the outer box 64 is dimensioned to accommodate a spacer unit 40 also shown in FIG. 5. The spacer unit 40 is also made of molded plastic and is of the same depth dimension as the base 54 but is molded to define partially enclosed separate recesses 42 which provide convenient storage locations for advertising literature, postcards, and the like. The spacer unit 40, it will be appreciated, will be sandwiched in and closed off on both right and left sides by the walls of the front and rear uprights in the final assembly thus providing pockets having open tops where the recesses 42 are currently shown. In this regard it will be appreciated that the height of the filler unit 40 is thus approximately the same but preferably not greater than the height of the front upright units 56 which are employed to construct the storage and display stands 52.

It will be appreciated that while the embodiments of FIGS. 1 and 6 have been disclosed with reference to a double and quadruple bin storage display stands, a single bin, triple bin or other configuration may also be constructed using the basic concepts disclosed herein. Moreover, the shape and overall size of the stand so constructed may also be varied as desired.

Looking again to FIGS. 6, 7 and 8 further description will be devoted to the configuration of the base 54. In this configuration the base comprises totally separable outer and inner box members 64 and 66, respectively. The outer box 34 is dimensioned to receive the bottom portions of the panels of the front and rear upright units 56 and 58 therein as shown with the upright units fitting snugly inside and facially abutting the upstanding walls of the outside box 64. Thereafter, the interior boxes 66 are press-fit down inside of the assembled uprights so as to trap the walls of the uprights between the inside and outside boxes as shown. Because the inside boxes 66 are straight sided, they may be inserted either as shown to provide additional storage depth or inverted to raise the stored product up away from the floor. If rigidity and/or waterproofing are not a problem, the outer box 64 need have no floor. The inserted box principle may be used to secure the top 62 as well.

Still other configurations may be employed. For example, all of the configurations illustrated herein are of square or rectangular shape whereas it will be readily appreciated that round, oblong, trapezoidal, and other geometric shapes may be readily employed again in accordance with the desires of the designer responsible for a specific display unit. In any event, none of the devices requires conventional fastener devices or interior strengthening frames and all may be readily assembled and disassembled for use, storage, or shipment as the case may be.

It is also to be made clear that the stand may be fabricated as a single piece of foldable material which, when folded, forms both front and rear upright portions. For example, a single blank of corrugated board may be cut to the desired pattern, creased and folded, the vertical abutting edges clipped or connected together, and the resulting enclosure-upright fit into the base channel as described.

In addition, the front upright may be eliminated entirely to accommodate long items such as shovels and rakes.

The embodiments of the invention in which an exclusive property or privilege is claimed are defined as follows:

1. A free-standing knock-down storage and display stand for providing a partial enclosure having interior space for goods and comprising a base defining a relatively narrow peripheral channel; a first upright portion forming part of said enclosure and having a wall thickness which may be snugly fit into said channel; and a second upright portion forming the balance of said enclosure and having a wall thickness which may be snugly fit into said channel; said first and second upright portions being disposed in oppositely facing relationship to define said partial enclosure with the upstanding edges thereof substantially abutting one another; the second upright portion being substantially taller than the first upright portion; and a top carried by the taller upright portion.

2. The stand defined in claim 1 further including a connector element receivingly between the abutting upstanding edges of the upright portions for holding said edges substantially in alignment.

3. The stand of claim 1 wherein the first and second upright portions are non-integral.

4. The stand of claim 1 wherein said base is rectangular in shape and said first and second upright units are three-sided to form a four-sided semi-enclosed space.

5. The stand of claim 4 wherein said base is of sufficient dimension to accommodate at least two of each of said first and second upright units disposed in a side-by-side abutting relationship with said abutting sides of said upright units having their bottom edges inserted in an intermediate groove formed in said base parallel to opposing sides of said rectangular shaped base.

6. The stand of claim 1 wherein the top of said base between said peripheral grooves is concave.

7. The stand of claim 1 wherein the base is a one-piece unit with the channel molded therein.

8. The stand of claim 1 wherein the base comprises separate outer and inner units with lateral clearance therebetween to define the channel.

9. A take-down storage and display stand comprising an outer base member having vertical sides, an inner base member having vertical sides and lateral dimensions slightly smaller than said outer base member and disposed within said outer base member creating a channel between said vertical walls of said base members, a front upright unit having a wall thickness which fits snugly into said channel and having the bottom edge thereof inserted in said first portion of said channel and a rear upright unit having a wall thickness which fits snugly into said channel and having the bottom edge thereof inserted in said channel.

10. The stand of claim 9 including at least two inner base members having vertical walls and combined lateral dimensions slightly smaller than said outer base member and disposed in a side-by-side relationship within said outer base member creating channels between adjacent vertical walls of said base members, and at least two of each of said first and second upright units disposed in a side-by-side abutting relationship with said abutting sides having their bottom edges inserted in the channels between adjacent vertical walls of said inner base members.

11. The stand of claim 10 further including a spacer unit disposed between the inner base member and uprights and of approximately the same height as the shortest upright.

12. A take-down storage and display stand comprising an outer base member having vertical sides, an inner base member having vertical sides and lateral dimensions slightly smaller than said outer base member and disposed within said outer base member creating a channel between said vertical walls of said base members, an open upright unit having a wall thickness which fits snugly into said channel and having the bottom edge thereof inserted in said channel and having side walls and a rear wall so as to define a partial enclosure which is closed at the rear and open to the front to receive goods therein; and a top disposed on and extending between the side walls of the upright unit and having a raised frontal surface for carrying indicia relating to said goods.

* * * * *